United States Patent [19]

Masaki et al.

[11] Patent Number: 4,928,435

[45] Date of Patent: May 29, 1990

[54] APPARATUS FOR WORKING CURVED SURFACES ON A WORKPIECE

[75] Inventors: Takeshi Masaki, Kawasaki; Koichi Kawata, Tama; Yukuo Sakagaito, Yokohama, all of Japan

[73] Assignee: Matsushita Electric Industrial Co., Ltd., Osaka, Japan

[21] Appl. No.: 206,724

[22] Filed: Jun. 15, 1988

Related U.S. Application Data

[63] Continuation of Ser. No. 865,419, May 21, 1986, abandoned.

[30] Foreign Application Priority Data

May 21, 1985 [JP] Japan ..... 60-108815
Nov. 8, 1985 [JP] Japan ..... 60-251339

[51] Int. Cl.[5] ..... B24B 13/00

[52] U.S. Cl. ..... 51/55; 51/124 L; 51/165.71; 51/284 R

[58] Field of Search ..... 51/33 R, 33 W, 55, 58, 51/59.55, 100 R, 124 R, 124 L, 165.71, 283 R, 284 R, 317

[56] References Cited

U.S. PATENT DOCUMENTS

| | | | |
|---|---|---|---|
| 3,021,647 | 2/1962 | Maitenaz | 51/55 |
| 3,167,884 | 2/1965 | Thompson | 51/33 R X |
| 3,534,506 | 10/1970 | Soong et al. | 51/55 X |
| 4,132,036 | 1/1979 | Doi et al. | 51/124 L |
| 4,178,720 | 12/1979 | Hashimoto | 51/124 L |
| 4,617,764 | 10/1986 | Reibakh | 51/33 R X |

FOREIGN PATENT DOCUMENTS

| | | | |
|---|---|---|---|
| 133697 | 10/1979 | Japan | 51/59.55 |
| 82161 | 7/1981 | Japan | 51/317 |
| 102669 | 6/1983 | Japan | 51/33 R |
| 791505 | 12/1980 | U.S.S.R. | 51/165.71 |

*Primary Examiner*—Robert P. Olszewski
*Attorney, Agent, or Firm*—Wenderoth, Lind & Ponack

[57] ABSTRACT

An apparatus for working an aspherical surface on a workpiece including a mechanism for adjusting a position of a workpiece in a horizontal direction, a rotary table having a vertical axis of rotation rotatably mounted on the adjusting mechanism, the rotary table including a work chuck for holding a workpiece on the rotary table, a spindle having a tool on a lower end thereof, a mechanism for rotating the spindle around an axial direction thereof and a compressed spring for supporting the spindle. A first mechanism adjusts a position of the tool in the axial direction of the spindle, the first mechanism including a sliding plate for sliding the spindle in the axial direction thereof. A second mechanism includes an axial mechanism for rotating the first mechanism about a horizontal axis of rotation perpendicular to the axial direction of the adjusting mechanism, the second mechanism supporting the first mechanism at one end of the axial mechanism, the second mechanism further including a balancer for balancing the first mechanism at the other end of the axial mechanism. A guide roller engages the balancer to position the second mechanism in a rotational position around the horizontal axis of rotation of the axial mechanism. A rotary encoder detects the rotational position of the second mechanism and a third mechanism adjusts a position of the second mechanism together with the first mechanism in a vertical direction.

11 Claims, 4 Drawing Sheets

APPARATUS FOR WORKING CURVED SURFACES ON A WORKPIECE

This application is a continuation, of now abandoned application Ser. No. 06/865,419 filed May 21, 1986.

BACKGROUND OF THE INVENTION

1. Field of the Invention

This invention relates to an apparatus for precisely working aspheric surfaces having mirror surfaces of metals, ceramic materials, glass materials, and so on.

2. Description of the Prior Art

High precision mirror surface processing of a mold for a plastic lens is conventionally performed by cutting or grinding with a computerized numerical control (CNC) lathe or curve generator and after which polishing is performed by a polishing machine or by hand works. Another conventional method for processing a mold for a plastic lens is by processing the material to be formed as the mold by single point diamond turning.

On the other hand, hard metals or ceramics are used as a mold for a glass lens. The mold made of hard and brittle materials such as ceramics or glasses is conventionally worked by moving a diamond grinder, which rotates at a high speed, along a desired working shape to simultaneously work the material into a desired configuration with a mirror surface.

When a free curved surface of a mold is worked by CNC milling or by CNC electrical discharge machining, cutting, grinding or electrical discharge machining is performed, control is provided with CNC positioning in accordance with predetermined working data. The curved surface worked by those methods has a surface roughness of the order of several micron meters and a mirror surface is not obtained. The process tolerance of the processed surface is on the order of several micron meters which is defined by the accuracy of the processing machines. As a result, a finishing process is required to obtain a mirror surface. Usually, the finishing process is performed by polishing the workpieces by hand with observing the processed shape. Instead of the hand polishing, automatic polishing methods for curved surfaces are sometimes introduced.

However, the conventional methods have several defects. When the cutting or grinding is performed, the worked surface has a surface roughness on the order of a micron meter and the shape accuracy is also in the range of a micron meter. Therefore, it is necessary to polish the workpiece to obtain an accuracy on the order of sub-micron meter by an operator's hand polishing which requires operator's skill and inefficiency. The electrical discharge machining has the same defects.

The diamond cutting and diamond grinding can obtain the surface roughness and shape accuracy on the order of a sub-micron meter which is able to realize processing a mirror surface. However, these methods require a finishing process to eliminate trace marks of the tool. As described above, the conventional methods require a preworking process for obtaining a desired shape and a finishing process for obtaining a mirror surface. Furthermore, the grindstone and the rotating mechanism thereof in a grinding process and the polisher in polishing process are difficult to miniaturize in terms of their sizes, and it is difficult to grind or polish a minute region on the curved surfaces.

SUMMARY OF THE INVENTION

It is therefore an object of the present invention to provide an apparatus for working aspheric surfaces on a workpiece which is able to shape a free curved surface and finish the same as a mirror surface simultaneously and easily.

It is another object of the present invention to provide an apparatus for working aspheric surfaces on a workpiece which makes it possible to form the curved surface as a mirror surface on the order of a sub-micron meter in roughness.

It is a further object of the present invention to provide an apparatus for working aspheric surfaces on a workpiece which allows a minute area to be accurately worked.

According to the present invention, an apparatus is provided which comprises a spindle having a tool at one end thereof, means for making a central axis of the spindle parallel with the normal direction at every point on a surface which is to be fabricated on a workpiece such that the center axis of the spindle coincides with the normal direction at a point on the assumed aspherical surface to be fabricated where the center axis of the spindle intersects the assumed aspherical surface, means for driving the spindle and tool, and means for contacting the tool to the workpiece with a constant pressure. The tool is preferable a flat type polisher or a spherical type polisher.

BRIEF DESCRIPTION OF THE DRAWINGS

The present invention will be described in detail by way of illustrative example with reference to the accompanying drawings, in which.

DETAILED DESCRIPTION OF THE INVENTION

Figure 1:
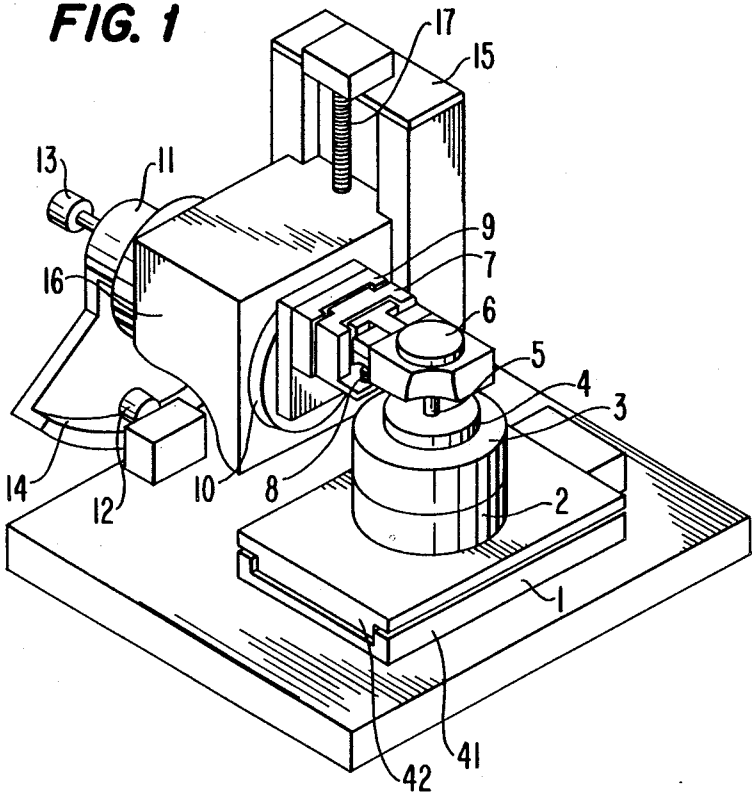
FIG. 1 is a perspective view of an apparatus for working curved surfaces on a workpiece according to the present invention.

FIG. 1 shows an arrangement of an apparatus for working curved or aspheric surfaces on a workpiece. Reference numeral 1 designates an X-axis mechanism which determines the location of a workpiece 4 in a horizontal or X-axis direction. The X-axis mechanism 1 comprises a fixed plate 41 and a slide plate 42 slidably mounted on the fixed plate 41. A rotary table 2 is rotatably mounted on the slide plate 42 of the X-axis mechanism 1. On the rotary table 2, a work chuck 3 is provided for supporting the workpiece 4 thereon in such a manner that the axis of rotation of the workpiece 4 coincides with the axis of rotation of the rotary table 2. A tool 5, such as a polisher, is mounted on a lower end of a rotatable spindle 6. The spindle 6 is freely slidable along the direction of the axis of rotation thereof (hereafter called the R-axis) with a slide means 7 slidably mounted on an R-axis mechanism 9. The R-axis mechanism 9 is provided on one surface of a θ-axis mechanism 10 in order to rotationally shift the spindle 6 around a θ-axis which is perpendicular to the R-axis. On the opposite surface of the θ-axis mechanism 10, a balancer 11 is provided for well balancing the θ-axis mechanism 10 to the rotationally shifted spindle 6. A roller 12 rotates along a guide face 14 of the balancer 11 to rotate the balancer 11 about the θ-axis, whereby the θ-axis mechanism 10 is rotated about the θ-axis. A rotary encoder 13 detects the angular location of the θ-axis mechanism 10. The θ-axis mechanism 10 is contained in a housing 16 which is movable in a vertical direction, hereinafter called the (Z-axis direction) along a screw 17 of a Z-axis mechanism 15.

Figure 2:
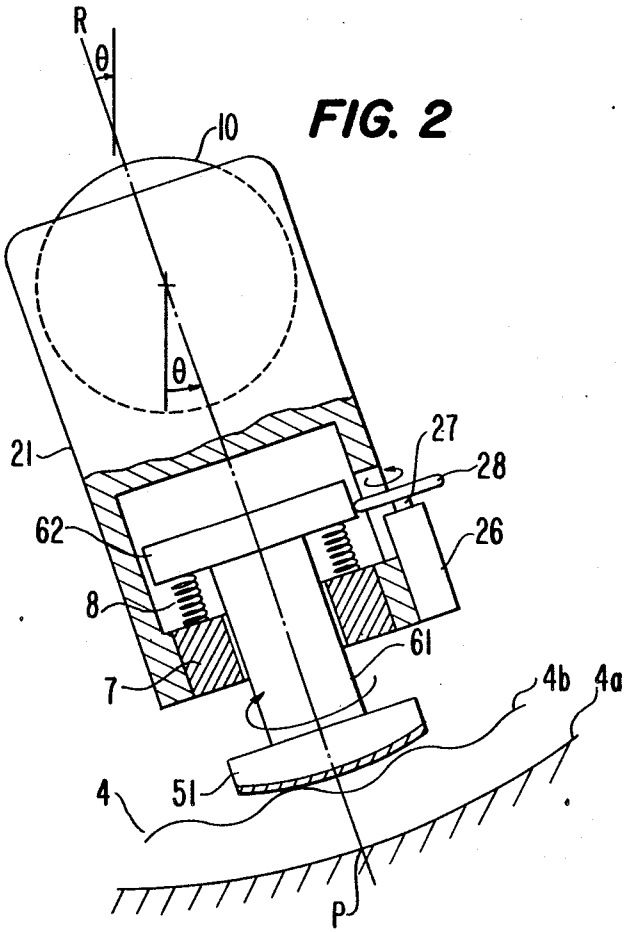
FIG. 2 is a front view, partly in cross section, of a working head portion of the apparatus of FIG. 1.

Referring to FIG. 2, a spindle rod 61 of the spindle 6 is supported rotatably and movably in the axial direction thereof (R direction) in a casing 21. On the lower end of the spindle rod 61, a plate polisher 51 housing convex surfaces as the tool 5 is provided. The polisher 51 is made of cast iron, tin, pitch or polyurethane. On the top end of the spindle rod 61, a base plate 62 is provided which is disposed in a cavity in the casing 21. A compressed spring 8 is mounted between the base plate 62 of the spindle 6 and a lower part of the slide means 7. The spring 8 holds the spindle rod 61 and polisher 51 in constant pressure. The base plate 62 is rotated by a capstan 28 which is mounted on an output shaft 27 of a motor 26. The casing 21 is rotated by the θ-axis mechanism 10 for adjusting the axial direction R of rotation of the spindle rod 61 to coincide with a direction which is normal to an arbitrary point P on a surface 4a, which is an assumed surface to be fabricated by working the surface 4b of the workpiece 4. In FIG. 2, the axial direction R is inclined by an angle θ from the vertical direction.

Figure 3:
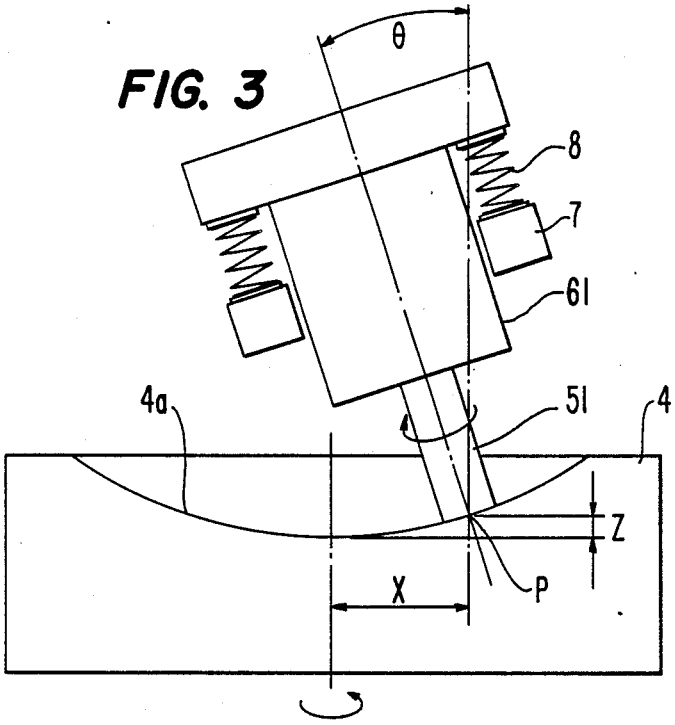
FIG. 3 is a fragmentary front view of the working head portion of the apparatus of FIG. 1.

Referring now to FIG. 3, operation of the apparatus will be explained. In FIG. 3, the polisher 51 is a slender one, but the plate polisher as shown in FIG. 2 may be also preferable.

In FIGS. 2 and 3, working data for coordinates X, Z, and angle θ for working the surface 46 into the desired shape 4a, which are calculated from a preworked shape of the workpiece 4, are stored in a control portion not shown in the figures. In operations, the R-axis mechanism 9 adjusts the location of the polisher 51 in such a manner that the top of the polisher 51 lies on the axis of rotation of the θ-axis mechanism 10. At the same time, the θ-axis mechanism 10 adjusts its rotational location in angular position to coincide the axial direction of the spindle rod 61 with the normal direction at a point P on an aspherical surface of the workpiece 4 in accordance with to the working data x, Z and θ of the point P. After the adjustment, the polisher 51 is placed in contact with the preworked surface 4b of the workpiece 4 in compression state to release the compression spring 8. In this state, the spindle rod 61 rises and falls in response to the shape errors of the preworked surface 4b of the workpiece 4. When the motor 26 is driven, the spindle rod 61 and the polisher 51 are rotated through the capstan 28. At the same time, the workpiece 4 is rotated by rotating the rotary table 2. As a result, the workpiece 4 is worked by the aid of grinding particles and working liquid.

Figure 4A:
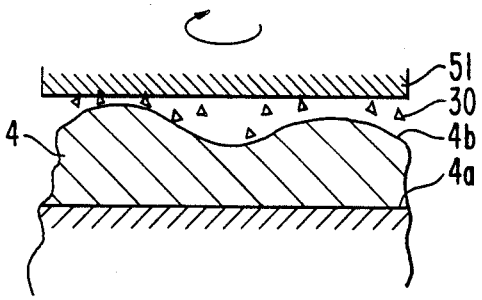
FIGS. 4A to 4C are cross-sectional side views explanatory of a process of working a workpiece according to the present invention.
Figure 4B:
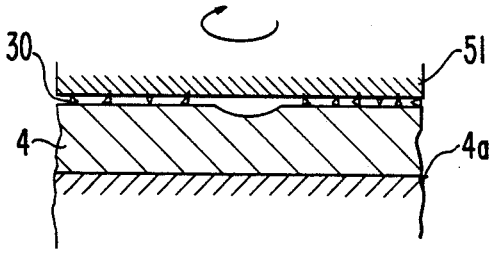
Figure 4C:
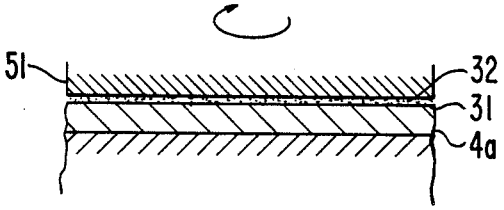

FIGS. 4A to 4C designate working steps. FIG. 4A shows a preworked state. The preworked surface 4b of the workpiece 4 has an uneven shape compared to the desired surface 4a to be worked. When the polisher 51 is rotated in a clockwise direction as shown by an arrow with the grinding particles 30 such as diamond particles, the preworked surface 4b of the workpiece 4 is worked as shown in FIG. 4B. In this step, the size of the grinding particles is comparatively large because of the uneven surface of the workpiece 4. After the uneven shape of the workpiece 4 has been removed, scratches 31 left on the worked surface are removed by working with smaller grinding particles 32 as shown in FIG. 4C. During the working, the polisher 51 and the spindle rod 61 fall with dead weight against the elastic force of the compressed spring 8, whereby working is performed by constant pressure of the polisher 51 against the workpiece.

As described above, shape formation and mirror finishing of the workpiece are simultaneously or continuously processed in the same working manner. These operations are successively repeated on other points or areas of the workpiece 4.

Figure 5:
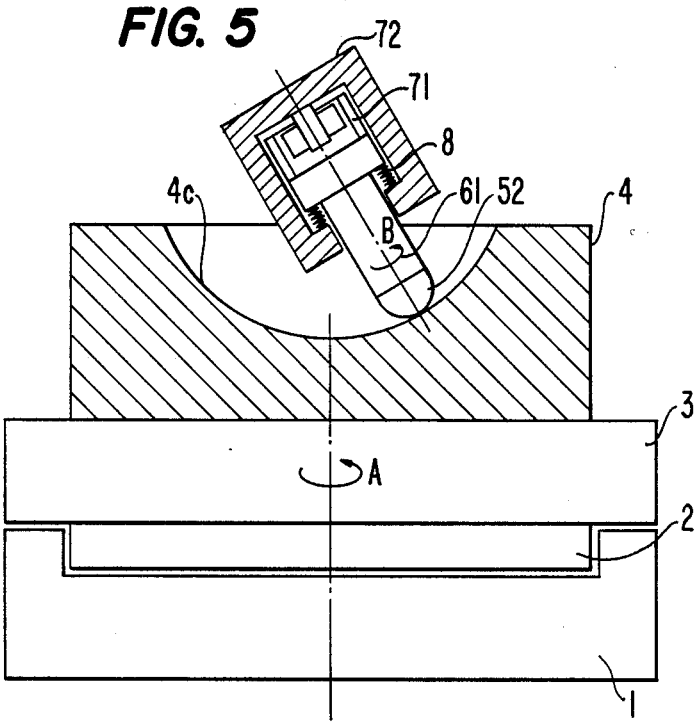
FIG. 5 is a front view, partly in cross section, of another embodiment of the working head portion of the apparatus according to the present and invention.

Referring now to FIG. 5 another embodiment of the invention will be explained. The embodiment employs a spherical polisher 52 having a hemispherical polishing surface for working a concaved aspherical surface 4C. The concave workpiece 4 is mounted on the work chuck 3 which is rotated in the direction of an arrow A by the rotary table 2 mounted on the X-axis mechanisms. The spherical polisher 52 is arranged on a lower end of the spindle rod 61, and rotated in the direction of arrow on B by a motor formed with a rotor 71 and a stator 72. The concave workpiece 4 and the spherical polisher 52 are arranged relatively to work aspherical surfaces. The spindle rod 61 and the spherical polisher 52 are supported by the compressed spring 8, and the spherical polisher 52 is pushed against the surface of the concave workpiece 4 in the normal direction at every point on a surface which is to be worked. When the spherical polisher 52 and the concave workpiece 4 are rotated with a suspension of grinding particles, the workpiece 4 is worked. The worked amount is controlled by relative moving speed of the spherical polisher 52 and the workpiece 4, pushing pressure of the spherical polisher 52, the number of the rotations of the spherical polisher 52 and the workpiece 4, and the size of the grinding particles. The spherical polisher 52 is made of metals of cast iron or tin, or soft or elastic materials such as polyurethane, cloth, or pitch. When the spherical polisher 52 is made of metals, the contact area on the workpiece 4 is very small, and stabilized lapping may be carried out. When the spherical polisher 52 is made of soft or elastic material, it is possible to lap in accuracy on the order of less than 0.01 micron meter.

Figure 6:
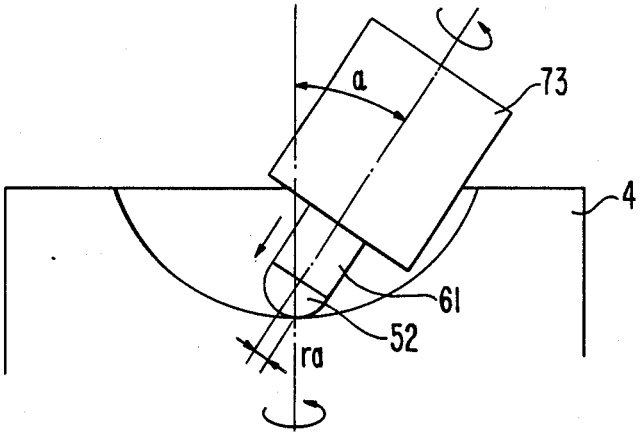
FIGS. 6 and 7 are respective explanatory front views of third and fourth embodiments of the working head portion of the apparatus according to the present invention.

FIG. 6 shows an example of working at a center position of the concave workpiece 4. The axial direction of the spindle rod 61 is inclined at an angle α from a vertical line passing through the working point which corresponds to the contact point of the spherical polisher 52 on the workpiece 4, the axial direction being shifted a distance ra from the center axis of the spherical workpiece 4 such that an axis passing through the contact point and a center of curvature of the hemispherical polishing surface coincides with a normal direction at a point on an assumed aspherical surface to be fabricated where the axis intersects the assumed aspherical surface. The working point has a certain speed of rotation which produces a high working force although the moving speed of the working point of the workpiece is zero.

Figure 7:
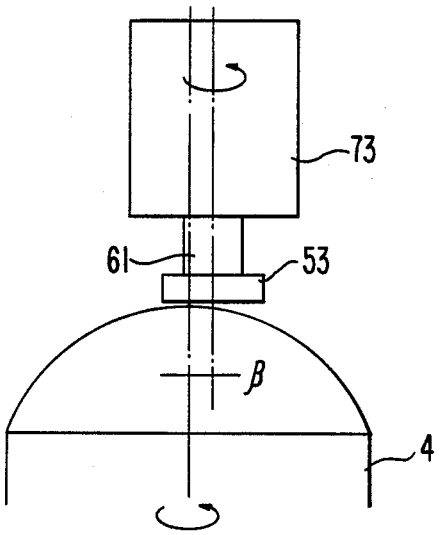

FIG. 7 shows an example of working at a center position of a convex workpiece 4. In this case, a flat polisher 53 is employed instead of the spherical polisher 52 in FIG. 6. The flat polisher 53 is provided in such a manner that the flat surface of the flat polisher 52 makes a right angle with the rotational axis of the spindle rod 61. The working point of the flat polisher 53 is shifted by a distance $\beta$ from the center of the flat polisher 53. The axis of rotation of the flat polisher 52 is adjusted in a parallel relation with the normal direction at the working point of the convex workpiece 4. Thus, the flat polisher 53 works the workpiece 4 from the normal direction of the worked point of the workpiece 4. The worked point of the workpiece 4 of FIG. 7 is the center or the top portion of the convex contour of the workpiece 4, where the moving speed is substantially zero while the workpiece 4 is rotating. Therefore, if the center of the flat polisher 53 contacts the worked point of the workpiece 4, no working is performed because of no rubbing. The offsetting of the axis of the flat polisher 53 from the working point by a distance $\beta$ avoids this problem.

The embodiments of FIGS. 6 and 7 are practicable to work a center position of the rotated workpiece 4 where the moving speed is zero.

As described above, the apparatus of the present invention makes it possible to work a desired aspherical shape on a workpiece with high accuracy by controlling the apparatus with data of X, Y, – and the preworking shape. The spindle 6 having the tool 5 is supported by the compressed spring 8 so that contact or push pressure of the tool 5 against the workpiece 4 is adjustable between zero and the dead weight of the supported spindle portion by the location of the R-axis mechanism 9. This means that the contact or push pressure of the tool 5 is substantially constant in small variation of tool location. According to the present invention, a ripple in or unevenness of the surface to be polished is small, so that the tool 5 is contacted to the workpiece 4 in constant pressure which allows the production of a surface roughness on the order of 0.01 micron.

The spindle 6 may be swung or vibrated instead of rotation thereof keeping its axial direction coincident or parallel with the normal direction at the point to be worked. In this case, the motor 26 and capstan 28 in FIG. 2 may be replaced by a vibration mechanism such as a clank driving mechanism.

The apparatus of the present invention is useful and effective to make a mold for plastic lenses, mirror polishing of ceramic or glass lenses, and so on.

What is claimed is:

1. An apparatus for working aspherical surfaces on a workpiece comprising:

a spindle having a tool on an end portion thereof;

means for adjusting said spindle so that a center axis of said spindle coincides with a normal direction at every point on an assumed aspherical surface to be fabricated on the workpiece where said center axis of said spindle intersects the assumed aspherical surface;

means for driving said spindle;

means for rotating said workpiece; and means for applying said tool to said workpiece with a substantially constant pressure.

2. An apparatus as claimed in claim 1, wherein said polisher is made of material selected from the group consisting of cast iron, tin, polyurethan, cloth and pitch.

3. An apparatus as claimed in claim 1, wherein said spindle is rotated.

4. An apparatus as claimed in claim 1, wherein said spindle is vibrated.

5. An apparatus as claimed in claim 1, wherein said applying means comprises a compressed spring for supporting said spindle and moving means for moving said spindle up and down.

6. An apparatus as claimed in claim 1, wherein said tool is a plate polisher having a convex polishing surface.

7. An apparatus as claimed in claim 1, wherein said tool is a polisher having a hemispherical polishing surface.

8. An apparatus for working aspherical surfaces on a workpiece comprising:

a spindle having a hemispherical polishing surface on a polishing tool mounted on an end portion of said spindle;

means for regulating said spindle in such a manner that a normal direction at every point on an assumed aspherical surface which is to be fabricated on the workpiece passes through a center of said hemispherical polishing surface, said means for regulating said spindle being further operable for shifting a contact point between the hemispherical tool polishing surface and the workpiece away from the center of said hemispherical polishing surface when a point located on the center of rotation of the workpiece is worked;

means for driving said spindle;

means for rotating said workpiece about a center of rotation; and means for applying said tool to said workpiece with a substantially constant pressure.

9. An apparatus for working an aspherical surface on a workpiece comprising:

means for adjusting a position of a workpiece in a horizontal direction;

a rotary table having a vertical axis of rotation rotatably mounted on said adjusting means, said rotary table including a work chuck for holding a workpiece on said rotary table;

a spindle having a tool on a lower end thereof;

means for rotating said spindle around an axial direction thereof;

a compressed spring means for supporting said spindle;

a first mechanism for adjusting a position of said tool in the axial direction of said spindle, said first mechanism including a sliding means for sliding said spindle in the axial direction thereof;

a second mechanism including axial means for rotating said first mechanism about a horizontal axis of rotation perpendicular to sad axial direction of said adjusting means, said second mechanism supporting said first mechanism at one end of said axial means, said second mechanism further including a balancer for balancing said first mechanism at the other end of said axial means;

means for positioning said second mechanism in a rotational position around said horizontal axis of rotation of said axial means;

a rotary encoder for detecting the rotational position of said second mechanism; and a third mechanism for adjusting a position of said second mechanism together with said first mechanism in a vertical direction.

10. An apparatus as claimed in claim 9, wherein said second mechanism positioning means comprises a roller contacted to a guide face of said balancer.

11. A method for working an aspherical surface on a workpiece comprising the steps of:

obtaining working data for working an aspherical configuration to be fabricated;

adjusting a rotation axis direction of a spindle having a tool at the end thereof to coincide with a normal direction at every point on an aspherical surface to be fabricated on the workpiece where the rotation axis direction intersects the aspherical surface;

applying said tool to said workpiece with a substantially constant pressure;

rotating said spindle around said rotation axis under the control of said working data; and rotating said workpiece around a rotational axis thereof.

* * * * *